US007412930B2

(12) United States Patent
Smith et al.

(10) Patent No.: US 7,412,930 B2
(45) Date of Patent: Aug. 19, 2008

(54) FRICTIONAL ROLL CONTROL APPARATUS FOR A SPINNING PROJECTILE

(75) Inventors: Douglas L. Smith, Bellevue, WA (US); Joseph P. Morris, Bothell, WA (US)

(73) Assignee: General Dynamic Ordnance and Tactical Systems, Inc., St. Petersburg, FL (US)

( * ) Notice: Subject to any disclaimer, the term of this patent is extended or adjusted under 35 U.S.C. 154(b) by 344 days.

(21) Appl. No.: 10/955,682

(22) Filed: Sep. 30, 2004

(65) Prior Publication Data

US 2006/0065775 A1 Mar. 30, 2006

(51) Int. Cl.
*F42B 10/02* (2006.01)
*F41G 7/00* (2006.01)
*F42B 10/00* (2006.01)

(52) U.S. Cl. ..... 102/473; 244/3.23; 244/3.1

(58) Field of Classification Search ..... 102/473, 102/490, 501; 244/3.1, 3.23
See application file for complete search history.

(56) References Cited

U.S. PATENT DOCUMENTS 4,163,534 A 8/1979 Seeger
4,296,895 A 10/1981 Pazmany
4,351,503 A 9/1982 Drori
4,438,893 A * 3/1984 Sands et al. ..... 244/3.21
4,523,728 A 6/1985 Frazer
4,565,340 A * 1/1986 Bains ..... 244/3.28
4,568,039 A * 2/1986 Smith et al. ..... 244/3.15
4,892,253 A 1/1990 Speicher et al.
4,964,593 A * 10/1990 Kranz ..... 244/3.24
5,164,538 A * 11/1992 McClain, III ..... 102/517
5,186,413 A * 2/1993 Deakin ..... 244/1 TD
5,379,968 A 1/1995 Grosso
5,393,012 A * 2/1995 Dunn ..... 244/3.23
5,425,514 A * 6/1995 Grosso ..... 244/3.22
5,452,864 A 9/1995 Alford et al.
5,505,408 A 4/1996 Speicher et al.
5,630,564 A 5/1997 Speicher et al.
5,647,558 A 7/1997 Linick
5,662,290 A 9/1997 Voigt
5,788,178 A 8/1998 Barrett et al.
5,842,547 A 12/1998 Carlson et al.
5,887,821 A 3/1999 Voigt et al.
5,932,836 A 8/1999 White
5,950,963 A 9/1999 Speicher et al.
6,073,880 A 6/2000 Voigt et al.
6,135,387 A 10/2000 Seidel
6,186,290 B1 2/2001 Carlson
6,186,443 B1 2/2001 Shaffer (Continued)

FOREIGN PATENT DOCUMENTS

WO WO 2005/026654 A2 3/2005

*Primary Examiner*—James S Bergin
(74) *Attorney, Agent, or Firm*—Shutts & Bowen, LLP

(57) ABSTRACT

The invention relates generally to a roll damping apparatus for a spinning projectile having a first section and a second section rotatably attached about a roll axis. The roll damping apparatus comprises a first portion attached to the front section, and a second portion attached to the rear section. The first portion is adapted to cause a braking frictional force to act on the second portion, the braking force being effective to control the spin rate of the front section relative to the rear section. The invention further relates to a spinning projectile having a roll damping apparatus.

13 Claims, 11 Drawing Sheets

U.S. PATENT DOCUMENTS

| | | | | |
|---|---|---|---|---|
| 6,224,013 | B1 | 5/2001 | Chisolm | |
| 6,315,239 | B1 | 11/2001 | Voigt | |
| 6,378,671 | B1 | 4/2002 | Carlson | |
| 6,422,507 | B1 * | 7/2002 | Lipeles | 244/3.13 |
| 6,446,906 | B1 | 9/2002 | Voigt et al. | |
| 6,460,446 | B1 | 10/2002 | Kathe | |
| 6,474,593 | B1 | 11/2002 | Lipeles et al. | |
| 6,581,871 | B2 | 6/2003 | Pijaca et al. | |
| 6,585,616 | B1 | 7/2003 | Robinson | |
| RE38,261 | E | 10/2003 | White | |
| 6,727,485 | B2 | 4/2004 | Rastegar et al. | |
| 6,752,352 | B1 | 6/2004 | May et al. | |
| 6,848,648 | B2 * | 2/2005 | Klestadt et al. | 244/3.23 |
| 6,869,044 | B2 * | 3/2005 | Geswender et al. | 244/3.29 |
| 6,880,780 | B1 | 4/2005 | Perry et al. | |
| 6,923,123 | B2 | 8/2005 | Rastegar et al. | |
| 6,935,242 | B2 | 8/2005 | Rastegar et al. | |
| 6,981,672 | B2 * | 1/2006 | Clancy et al. | 244/3.24 |
| 7,090,163 | B2 | 8/2006 | Rastegar et al. | |
| 2005/0150999 | A1 | 7/2005 | Ericson et al. | |

* cited by examiner

FRICTIONAL ROLL CONTROL APPARATUS FOR A SPINNING PROJECTILE

BACKGROUND OF THE INVENTION

The invention relates generally to methods and apparatuses for controlling the trajectory of a spinning projectile. The invention further relates to roll damping apparatuses for controlling the spin of a first section of a spinning projectile relative to a second section using frictional forces, wherein the first and second are rotatably attached about a roll axis of the projectile, and methods for controlling the spin of a first section of a spinning projectile relative to a second section using frictional forces.

In certain military applications, there is a significant need for "smart" projectiles wherein the operator can effectively control the course the projectile takes and the target location that is impacted. Such navigational control requires the ability to impart precise forces to a rapidly spinning projectile with respect to the Earth inertial frame to achieve a desired directional course. Past devices have used arrays of propulsive outlets, fuels and pyrotechnics to produce the necessary forces for the desired two-dimensional course correction. However, these devices suffer from significant disadvantages, such as the danger of premature explosion, and the shock caused by these devices often leads to imprecise course corrections.

Others have attempted to provide two-dimensional course correction in a spinning projectile with a front and rear section. For example, in U.S. Pat. No. 5,452,864, Alford et al. describe a method and apparatus for controlling the roll of a projectile using an electromechanical roll control system. The Alford electromechanical system utilizes an electromagnetic torque created by an armature coil interacting with magnets mounted in the rear section to adjust the spin rate of the front section. However, the reliance on the magnetic forces to slow the sections relative to one another illustrates that the Alford electromechanical system would have to be rather large, and require large amounts of power, to overcome the rotational inertia of the spinning front section to control the roll of the projectile.

Thus, there is a need for a method and apparatus for controlling the spin rate of a two-section, spinning projectile that can control the relative speeds of rotation of the two spinning sections, despin one section relative to the other, maintain a non-rotational state relative to an Earth inertial reference frame, and have the ability to reorient the projectile to a new non-rotational state position. There is a further need for such a method and apparatus that is compact, efficient, robust, easily scalable, requires little power, and avoids the disadvantages of known devices.

Accordingly, the present invention provides a roll damping apparatus, and methods of employing the same to control the spin of a spinning projectile, that overcome the disadvantages of known devices while offering features not present in known devices. Although certain deficiencies in the related art are described in this background discussion and elsewhere, it will be understood that these deficiencies were not necessarily heretofore recognized or known as deficiencies. Furthermore, it will be understood that, to the extent that one or more of the deficiencies described herein may be found in an embodiment of the claimed invention, the presence of such deficiencies does not detract from the novelty or non-obviousness of the invention or remove the embodiment from the scope of the claimed invention.

SUMMARY OF THE INVENTION

The invention, according to one embodiment, relates to a spinning projectile having a roll axis. The projectile comprises a front section rotatable about the roll axis, a rear section rotatable about the roll axis, the rear section rotatably attached to the front section, and a roll damping apparatus. The roll damping apparatus includes a first portion attached to the front section, a second portion attached to the rear section, wherein the first portion is adapted to cause a frictional force to act on the second portion. The frictional force is effective to control a spin rate of the front section relative to the rear section.

The invention, according to another embodiment, relates to a roll damping apparatus for a spinning projectile having a first section and a second section rotatably attached about a roll axis. The roll damping apparatus comprises a first portion attached to the front section, and a second portion attached to the rear section. The first portion is adapted to cause a frictional force to act on the second portion, the frictional force being effective to control the spin rate of the front section relative to the rear section.

The invention, according to another embodiment, relates to a method of controlling the roll of a projectile having a front section and rear section rotatably attached about a roll axis, and a roll damping apparatus. The method comprises selectively controlling a first portion of the roll damping apparatus attached to the front section to cause a frictional force to act on a second portion of the roll damping apparatus attached to the rear section, the frictional force being effective to control a spin rate of the front section relative to the rear section.

BRIEF DESCRIPTION OF THE DRAWINGS

The present invention can be more fully understood by reading the following detailed description of the presently preferred embodiments together with the accompanying drawings, in which like reference indicators are used to designate like elements, and in which.

DETAILED DESCRIPTION OF PREFERRED EMBODIMENTS

"Smart" projectiles generally include those projectiles in which a guidance computer algorithm or operator may effectively control the course/trajectory the projectile takes and the target location that is impacted. In order to allow for course correction and navigation, the guidance computer algorithm or operator must be able to impart precise forces on the projectile, subsequent to launch, with respect to the Earth inertial frame. This presents a particular problem for a spinning projectile that does not maintain its orientation relative to the Earth inertial frame so that the appropriate forces could be applied to the projectile. However, with projectiles comprised of two sections, one section may be configured so that it maintains its orientation relative to the Earth inertial frame, while the other section continues to spin. The present invention provides various embodiments of a roll damping apparatus that allows a guidance computer algorithm or operator to control the spin of a first section of a projectile relative to a second section of the projectile so that the appropriate forces may be applied to the projectile to effectively control the course the projectile takes and the target location that is impacted.

Figure 1:
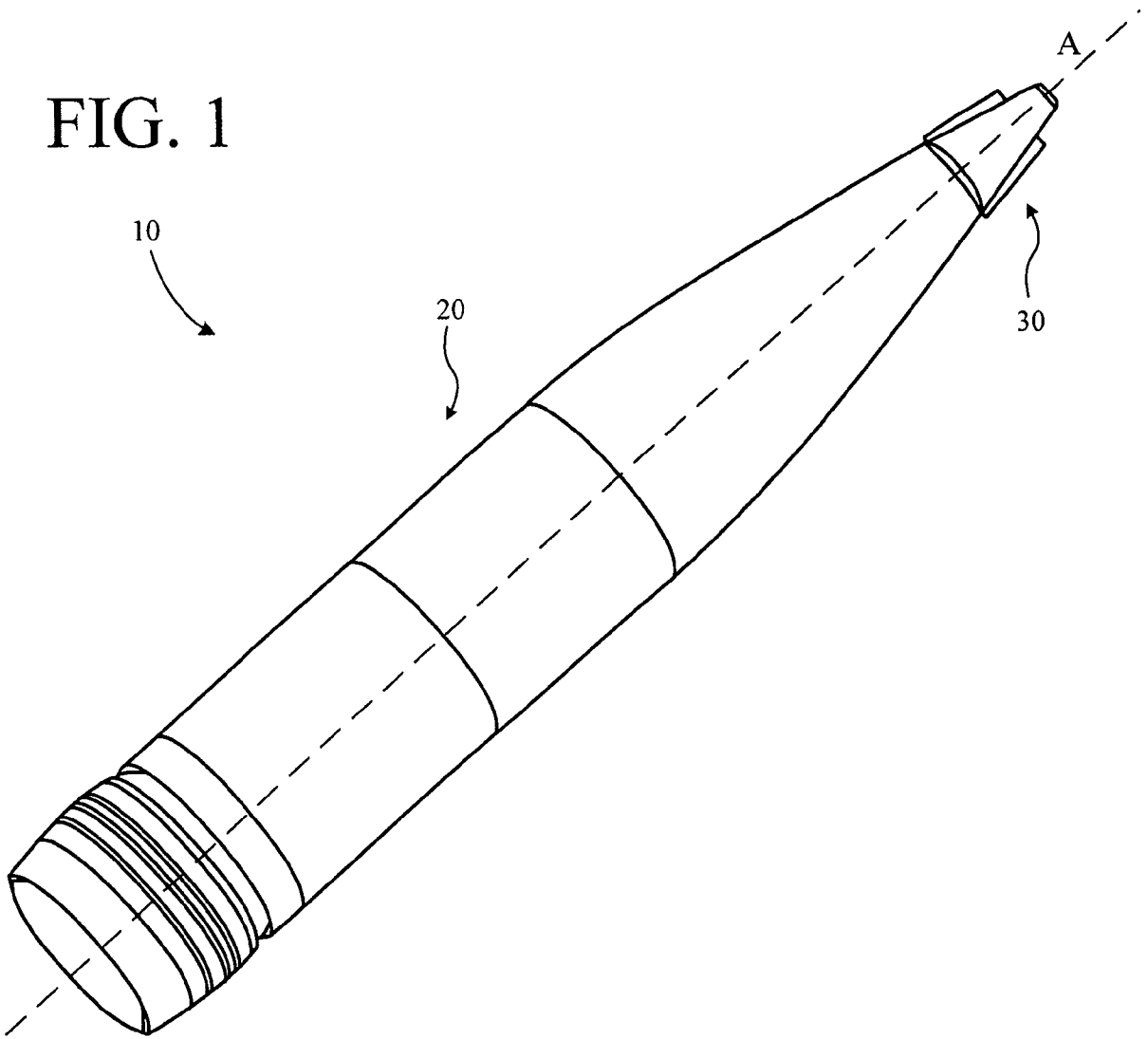
FIG. 1 shows a perspective view of an illustrative projectile in accordance with one embodiment of the invention.

FIG. 1 shows a perspective view of an illustrative projectile in accordance with one embodiment of the invention. Projectile 10 is comprised of a front section 30 and rear section 20 that are rotatably attached, or coupled via a rotational joint with a single degree of freedom, so that they may rotate relative to one another about the roll axis A of projectile 10. In this embodiment, projectile 10 is an artillery round that may be fired from a large caliber gun, such as a 155 mm L/39 NATO Howitzer (not illustrated). In alternate embodiments, the projectile may take the form of other projectiles known in the art.

With this embodiment, the firing of projectile 10 would impart an initial rotation (in the same direction) to both front section 30 and rear section 20 about the roll axis A. However, to allow for two-dimensional course correction and navigational control of projectile 10, the spin of front section 30 must be controlled so that appropriate forces can be applied and reorient the projectile 10 with respect to the Earth inertial reference frame. Control over the spin of the front section 30 can be achieved by applying a torque on front section 30 to cause it to spin counter to the spin of the rear section 20, and selectively generating a braking force between the front section 30 and rear section 20 so that the front section 30 maintains its orientation relative to the Earth inertial frame.

To provide the necessary counter torque, aerosurfaces (described in more detail below) are mounted externally on front section 30. Subsequent to firing, the aerosurfaces would begin to apply torque to the front section 30 counter to the rotation of rear section 20. This causes the front section 30 to rotate in the opposite direction as the rear section 20. Furthermore, projectile 10 employs a roll damping apparatus that counteracts the torque created by the aerosurfaces and effectively controls the rate of spin of the front section 30 vis-à-vis the rear section 20. With the spin of the front section 30 under control, the operator can utilize canards (described in more detail below) to control the trajectory of the projectile 10.

Figure 2:
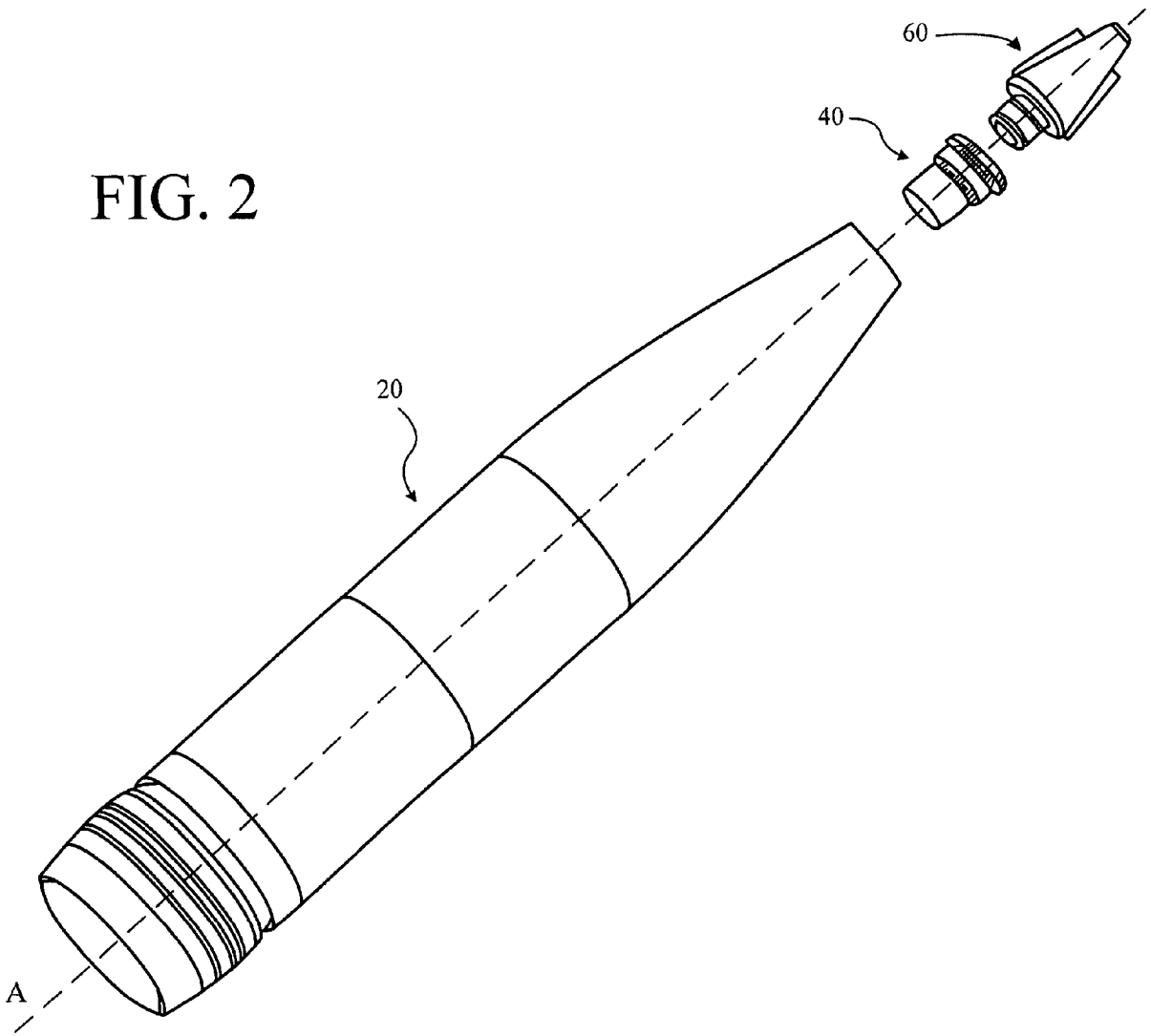
FIG. 2 shows an exploded view of the projectile of FIG. 1 in further detail in accordance with one embodiment of the invention.

To provide further illustration, FIG. 2 shows an exploded view of projectile 10 broken into three portions, including rear section 20, nose base 40, and nose portion 60. Although shown as a separate component, for purposes of these embodiments, nose base 40 forms part of the rear section 20, and may be threaded on to rear section 20 using cooperating threads on both components. Nose portion 60 is generally comprised of a guidance integrated fuze ("GIF"). Nose portion 60 is rotatably attached, or rotationally decoupled, to the nose base 40 about the roll axis A. The rotatable attachment between the nose portion 60 and nose base 40 allows the front section 30 to rotate vis-à-vis the rear section 20.

To control the spin rate of front section 30, a roll damping apparatus is provided at the interface between nose base 40 and nose portion 60. The roll damping apparatus generally includes a stator portion that is attached to and mounted in the front section 30 (or more specifically, nose portion 60), and a rotating portion that is attached to and mounted in the rear section 20 (or more specifically, nose base 40). Based upon predetermined control parameters, at the appropriate time after launch, the stator portion and rotating portion interact to create a frictional force that slows the spin of the front section 30 vis-à-vis the rear section 20.

Figure 3:
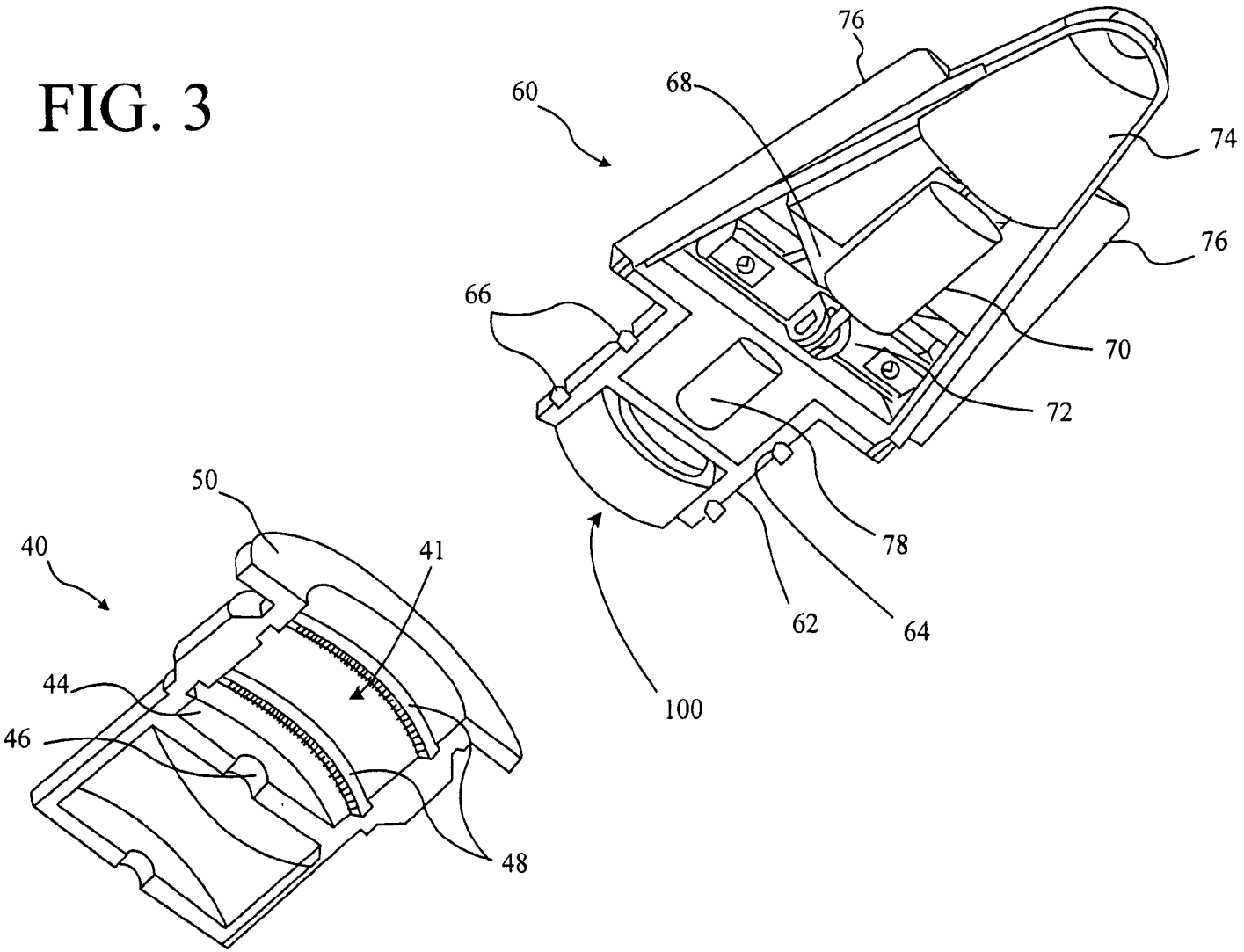
FIG. 3 shows a sectional perspective view of the nose base and nose portion of FIGS. 1-2 in further detail in accordance with an embodiment of the invention.
Figure 4:
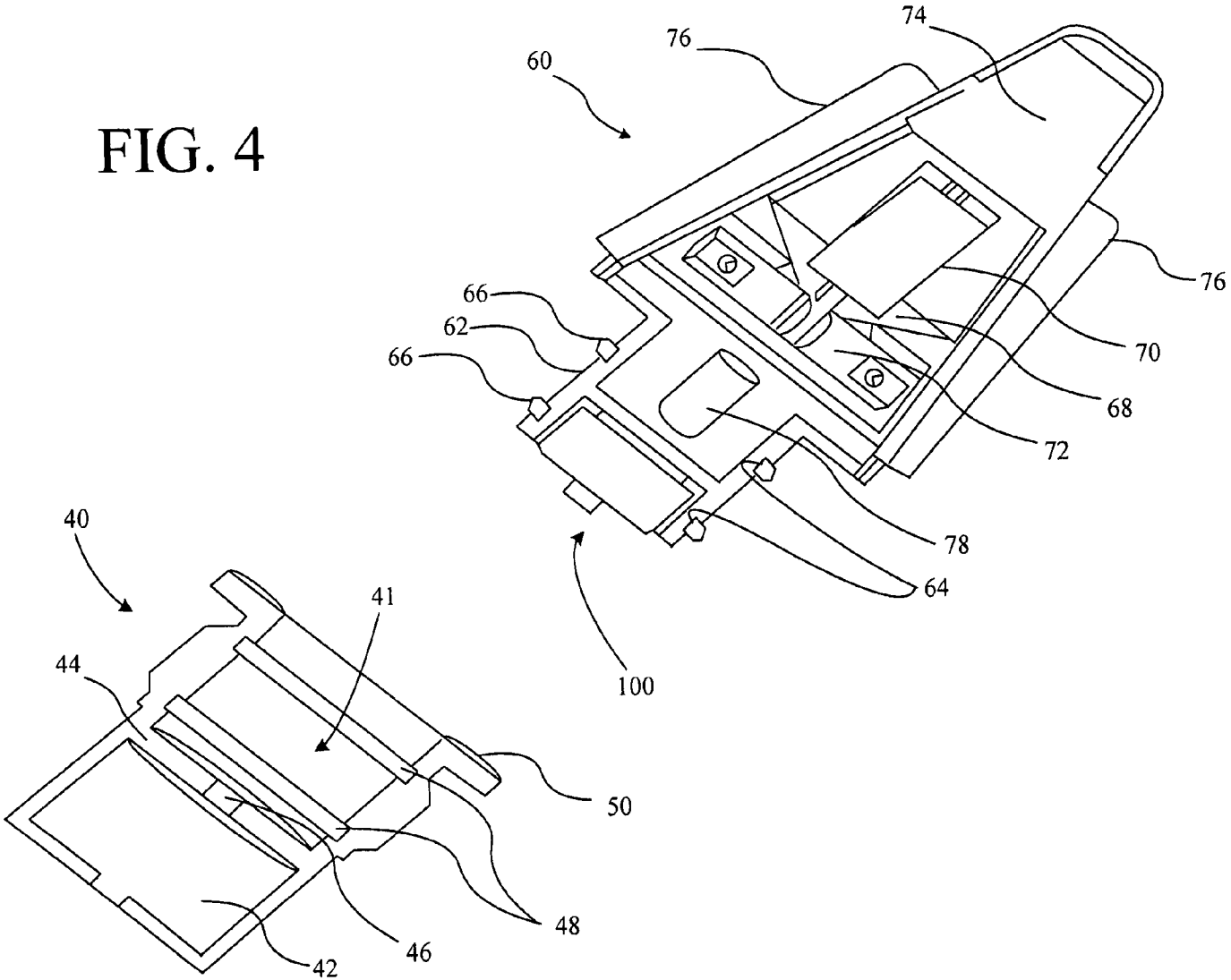
FIG. 4 shows a sectional side view of the nose base and nose portion of FIGS. 1-2 in further detail in accordance with an embodiment of the invention.

FIGS. 3 and 4 show a sectional perspective view and sectional side view, respectively, of the nose base and nose portion of FIGS. 1-2 in further detail in accordance with another embodiment of the invention. As shown, nose base 40 is a generally tubular member that is adapted to be received within the base of projectile 10 up to shoulder 50. Nose base 40 generally includes front and rear portions separated by a central axial rib 44. In the rear portion, a chamber 42 is provided for safety and arming assemblies that initiate the payload integrated into the projectile, or artillery round. The front portion includes a cavity 41 for receiving the neck portion 62 of the nose portion 60. The inner walls of cavity 41 have circumferential grooves 48 formed therein for the receipt of bearings 66 that allow the rotation of the nose portion 60 relative to the nose base 40, yet retain the axial arrangement between the two components. Neck portion 62 of nose portion 60 includes external grooves 64 for receipt of bearings 66 to cooperate with grooves 48 and allow rotational movement. It should be appreciated that the bearings may come in many forms that may be dictated by the design requirements of the device.

As described above, aerosurfaces 76 are mounted externally on the leading outer surfaces of nose portion 60. In an alternate embodiment, the aerosurfaces 76 may be stowed initially, and then deployed at launch. A number of components are also disposed within the nose portion. For example, canards 68 are stowed within nose portion 60 until later deployed for guidance control. To control the deployed canards 68, a canard actuator 70 and canard actuator assembly 72 are also located within nose portion 60. The operation of the canard actuator 70 and canard actuator assembly 72 allow the operator to control the movement of the deployed canards 68, and effectively impart the necessary forces to reorient the projectile. In this embodiment, nose portion 60 further includes a guidance system 78 for providing control over the trajectory and movement of the projectile 10, in combination with the roll damping apparatus control system.

To counteract the torque of the aerosurfaces 76, and in effect, control the rotation of the front section 30 and rear section 20 relative to one another, projectile 10 utilizes a roll damping apparatus 100. This roll damping apparatus 100 generally includes a stator portion attached to the nose portion 60, and a rotating portion attached to the nose base 40 at central axial rib 44. Based upon predetermined control parameters, the stator portion causes a frictional force to be applied to the rotating portion, which in turn, slows the rotation of the front section relative to the rear section. Although FIGS. 3-4 show an exploded view with the roll damping apparatus 100 attached to the nose portion 60, as assembled, the stator portion of roll damping apparatus 100 is attached to the nose portion 60, while the rotating portion is attached to and mounted in the nose base 40.

Figure 5:
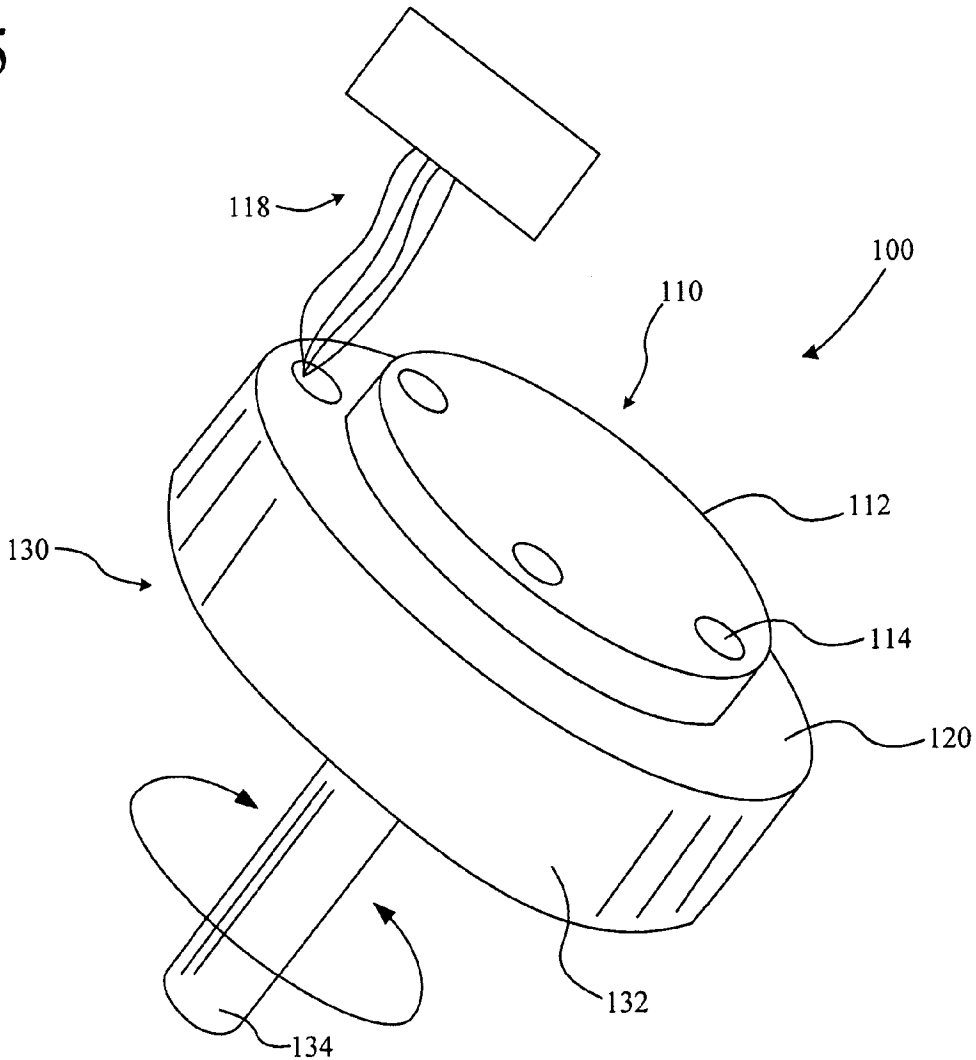
FIG. 5 is a perspective view of the roll damping apparatus of FIGS. 3-4 in further detail in accordance with an embodiment of the invention.

FIG. 5 is a perspective view of the roll damping apparatus of FIGS. 3-4 in further detail in accordance with an embodiment of the invention. Roll damping apparatus 100 includes a stator portion 110 and a rotating portion 130. The stator portion 110 includes an attachment plate 112 affixed to the stator housing. The attachment plate 112 serves as the point of connection to the nose portion 60 by a plurality of connectors 114. The stator portion 110 is partially disposed within the housing 132 of the rotating portion 130. In this embodiment, rotating shaft 134 is attached to housing 132, and further is disposed at least partially within the stator housing 120. A rotor 136 is attached to the rotating shaft 134 within the stator housing 120. Rotor 136 may comprise a disc-shaped member, or a plurality of members projecting-outwardly from shaft 134 in a spoke-like manner. In alternate embodiments, rotating portion 130 may be comprised of only shaft 134 and rotor 136, without housing 132. It should be appreciated that bearings (not shown) may be included in the stator assembly 110 to support the rotating shaft 134 with which the housing 132 and rotor 136 rotate.

Figure 6:
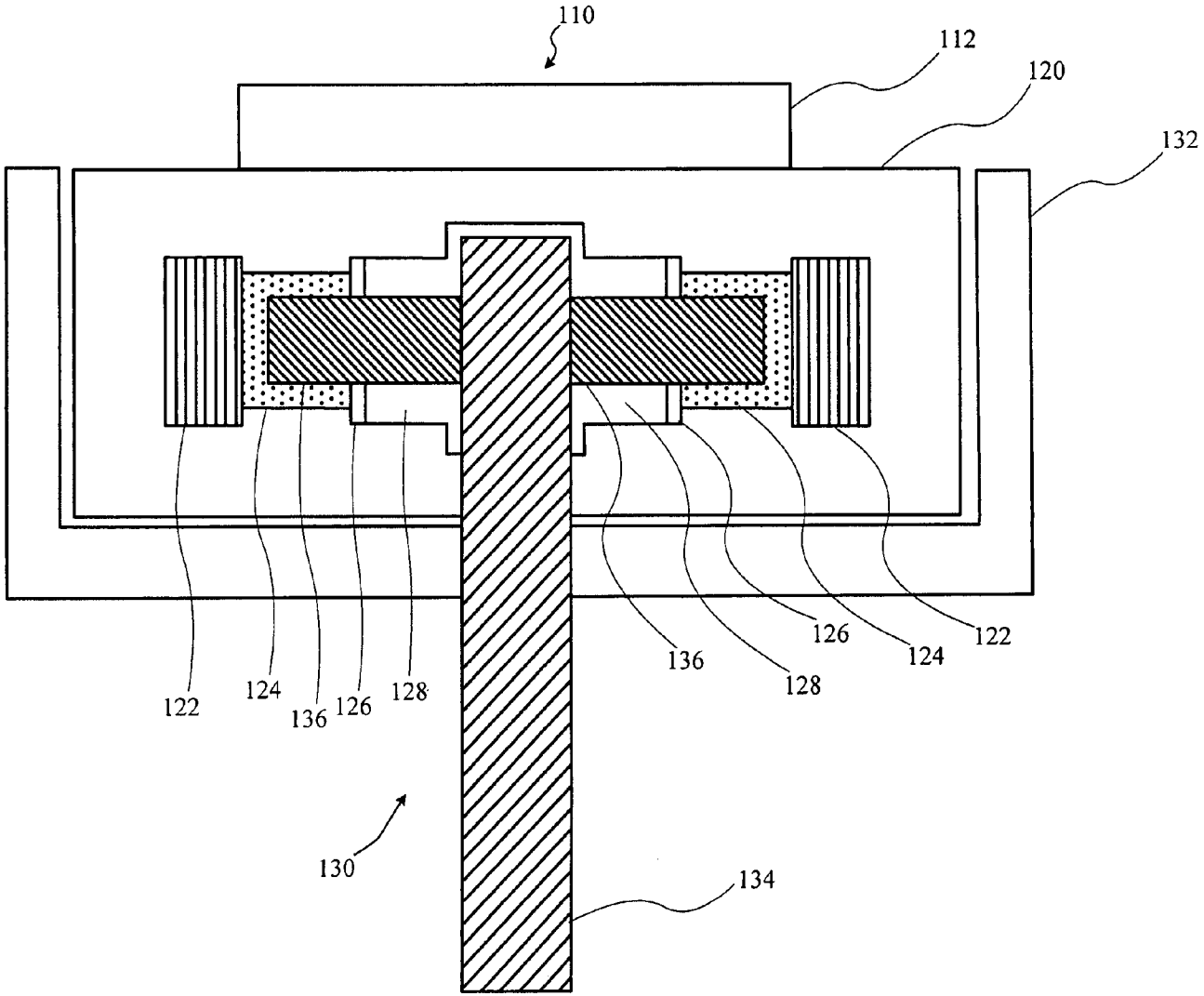
FIG. 6 is a side sectional view of the roll damping apparatus of FIG. 5 in further detail in accordance with one embodiment of the invention.

FIG. 6 is a side sectional view of the roll damping apparatus of FIG. 5 in further detail in accordance with one embodiment of the invention. In this embodiment, the stator housing 120 includes a series of coils 122 disposed circumferentially about a contained volume of magneto-rheological ("MR") fluid 124. The rotor 136 that is attached to the rotating shaft 134 is disposed within the housing 120 such that at least a portion of the rotor 136 is rotatable within the MR fluid 124. The MR fluid 124 is prevented from escaping into the inner chamber 128 of housing 120 by a plurality of seals 126.

In operation, the rotating portion 130 is configured to rotate with rear section 20 relative to the stator portion 110 attached to front section 30 about the roll axis A. When the necessary roll damping is needed, power assembly 118 (coupled to the stator assembly 110) is controlled to provide the necessary current within coils 122. When energized, coils 122 act as an electromagnet and apply an electromagnetic field to MR fluid 124. In this embodiment, MR fluid 124 is a fluid comprised of soft-magnetic particles disposed within a liquid carrier. Exemplary magneto-rheological fluids are disclosed in U.S. Pat. No. 6,186,290 to Carlson, the contents of which are incorporated by reference in its entirety.

The electromagnetic field applied to MR fluid 124 increases the viscosity of the MR fluid 124, causing it to thicken as a result of being exposed to the magnetic field. The increased viscosity increases the friction forces applied to the rotor 136 by MR fluid 124 that are effective to slow its rotation, which in turn, slows the rotation of rotating portion 130 relative to stator portion 110. It should be appreciated that in order to provide precise braking control, the level of magnetic field applied to the MR fluid may be varied, such that the higher the magnetic field strength exposed to the MR fluid, the higher the restraining frictional force or torque that will be applied against rotor 136.

In alternate embodiments, the rotation of the rear section relative to the front section may be controlled by the stator portion of the roll damping apparatus applying a direct physical contact to the rotating portion, or vice versa, to create a frictional force that can be controlled to slow the relative spins. For example, the roll damping apparatus may comprise a magnetically actuated motion control device that acts in a manner similar to a brake pad. Accordingly, FIG. 7 is a side sectional view of an illustrative roll damping apparatus in accordance with another embodiment of the invention.

Figure 7:
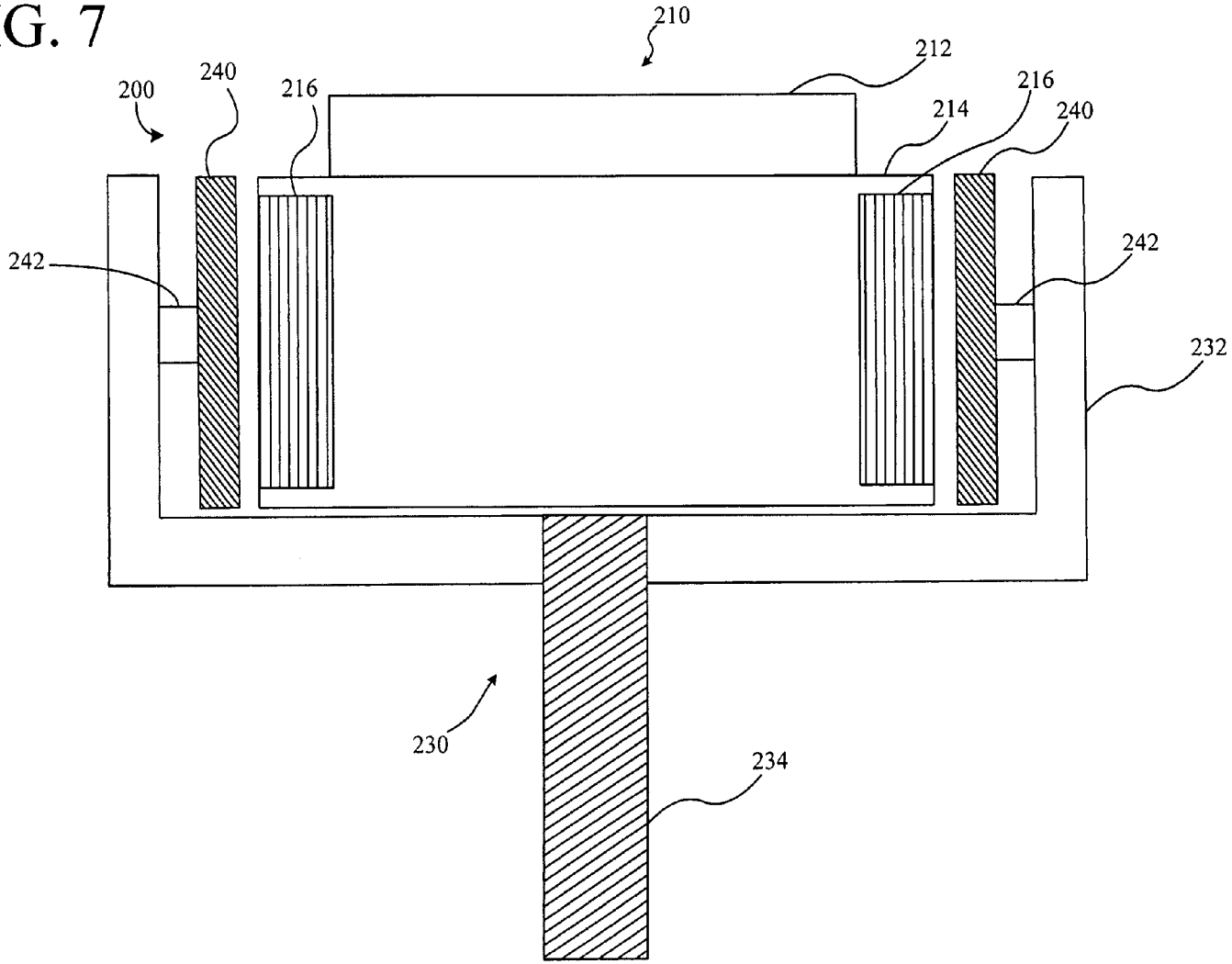
FIG. 7 is a side sectional view of an illustrative roll damping apparatus in accordance with another embodiment of the invention.

As shown in FIG. 7, roll damping apparatus 200 includes a stator portion 210 and rotating portion 230. The stator portion 210 comprises an attachment plate 212 attached to a central steel bobbin 214. The attachment plate 212 also serves as the point of connection to the nose portion of the projectile. Coils 216 are wound around the bobbin 214. A power assembly (not illustrated) is coupled to the stator portion 210 and is controllable to provide the necessary current within coils 216 to create an electromagnetic field.

The rotating portion 230 includes a flexible braking member 240 attached to the rotatable housing 232 by flexible connectors 242. In this embodiment, braking member 240 is comprised of a several sections that are each separately attached to housing 232. However, in other embodiments, braking member 240 may be a single piece that extends circumferentially around the inside wall of housing 232. Rotating portion 230 further includes a rotating shaft 234 that is attached to the rotatable housing 232, and mountable to the rear section of the projectile.

Figure 8:
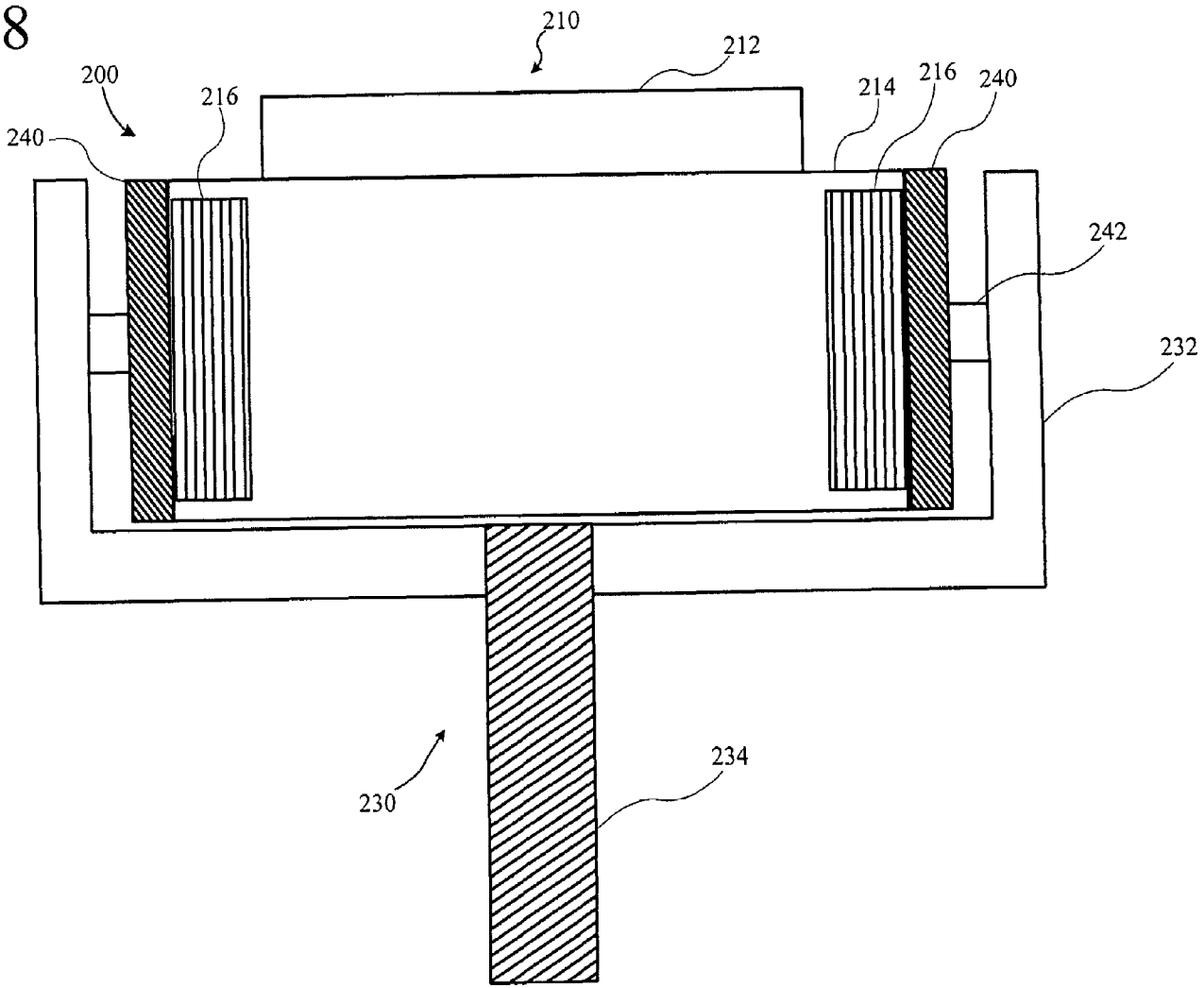
FIG. 8 is a side sectional view of the roll damping apparatus of FIG. 7 in further detail in another embodiment of the invention.

In operation, the rotating assembly 230 rotates about the stator assembly 210 until the necessary spin correction is needed. As shown in FIG. 8, which is a side sectional view of the roll damping apparatus of FIG. 7 with the braking member deployed, the braking member 240 is drawn to the energized coils 216 to generate high frictional forces between braking member 240 and bobbin 214. In alternate embodiments, a brake pad may be attached to the bobbin 214 to provide the contact surface for interfacing with the braking member 240 when the coils 216 are energized.

Although the embodiments of the roll damping apparatuses described herein generally include a rotating shaft that does not extend through the top of the stator housing and attachment plate, alternate embodiments may include such an arrangement. For example, the roll damping apparatus may comprise other braking devices, such as those described in U.S. Pat. No. 6,378,671 to Carlson, U.S. Pat. No. 6,186,290 to Carlson, and U.S. Pat. No. 5,842,547 to Carlson et al., the contents of which are each incorporated by reference herein in their entirety.

Figure 9:
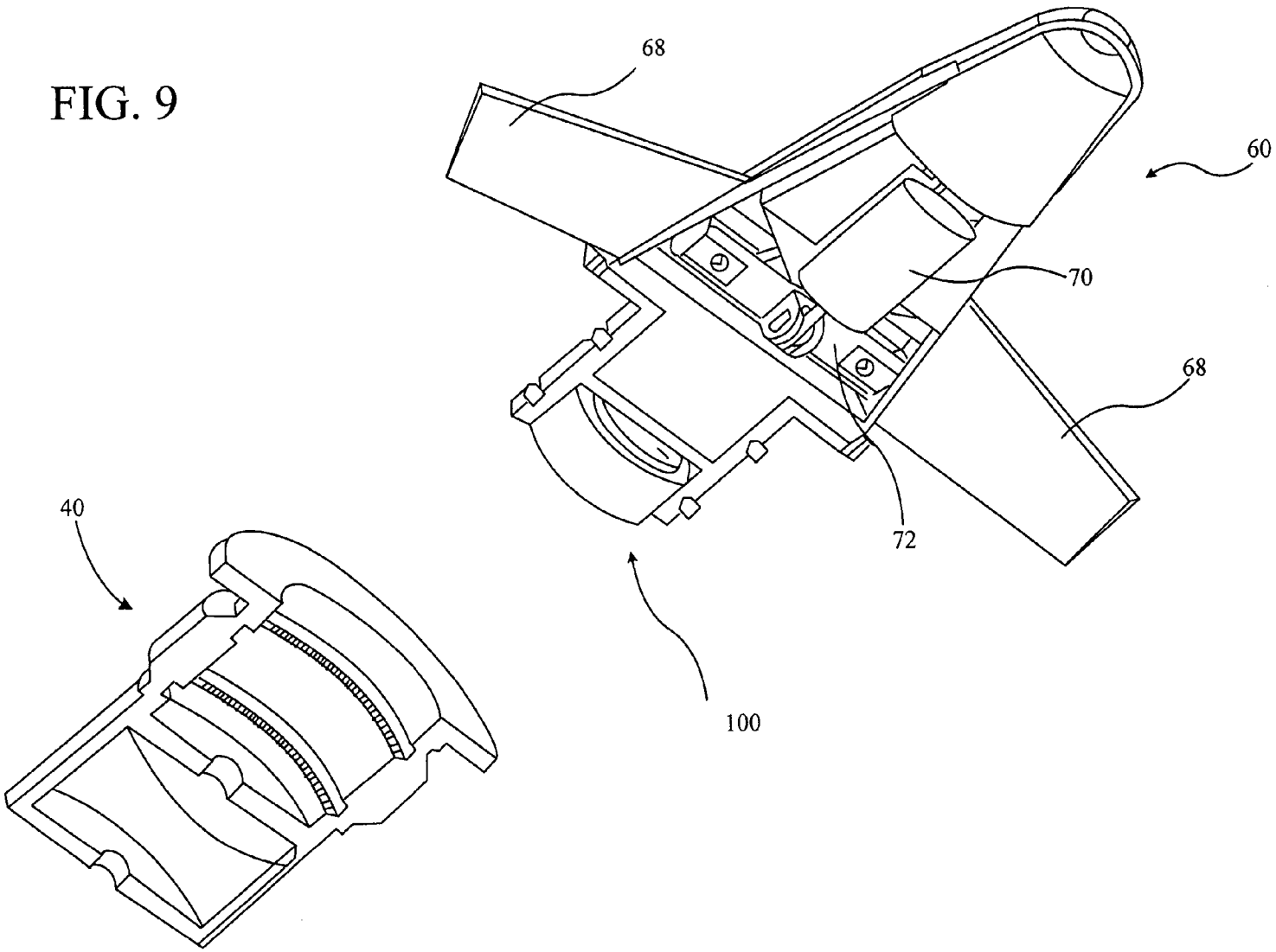
FIG. 9 is a perspective sectional view of the nose base and nose portion of FIGS. 1-2 in further detail in accordance with another embodiment of the invention.

FIG. 9 is a perspective sectional view of the nose base and nose portion of FIGS. 1-2 in further detail in accordance with another embodiment of the invention. As shown in FIG. 9, canards 68 are shown in a deployed state, and aerosurfaces 76 have been jettisoned from the projectile 10. As described above, the canard actuator 70 and canard actuator assembly 72 allow the operator (or control system) to control the movement of the deployed canards 68, and effectively impart the necessary forces to reorient the front section within the Earth inertial reference frame. It should be appreciated that, in alternate embodiments, canards 68 may be actuated by multiple actuators. In other embodiments, canards 68 may be contoured, or canted, to provide the necessary torque to cause the front section 30 to rotate counter to the rear section 20. Moreover, in further embodiments, the aerosurfaces of the front section 30 may remain intact following canard deployment (i.e., not jettisoned).

Figure 10:
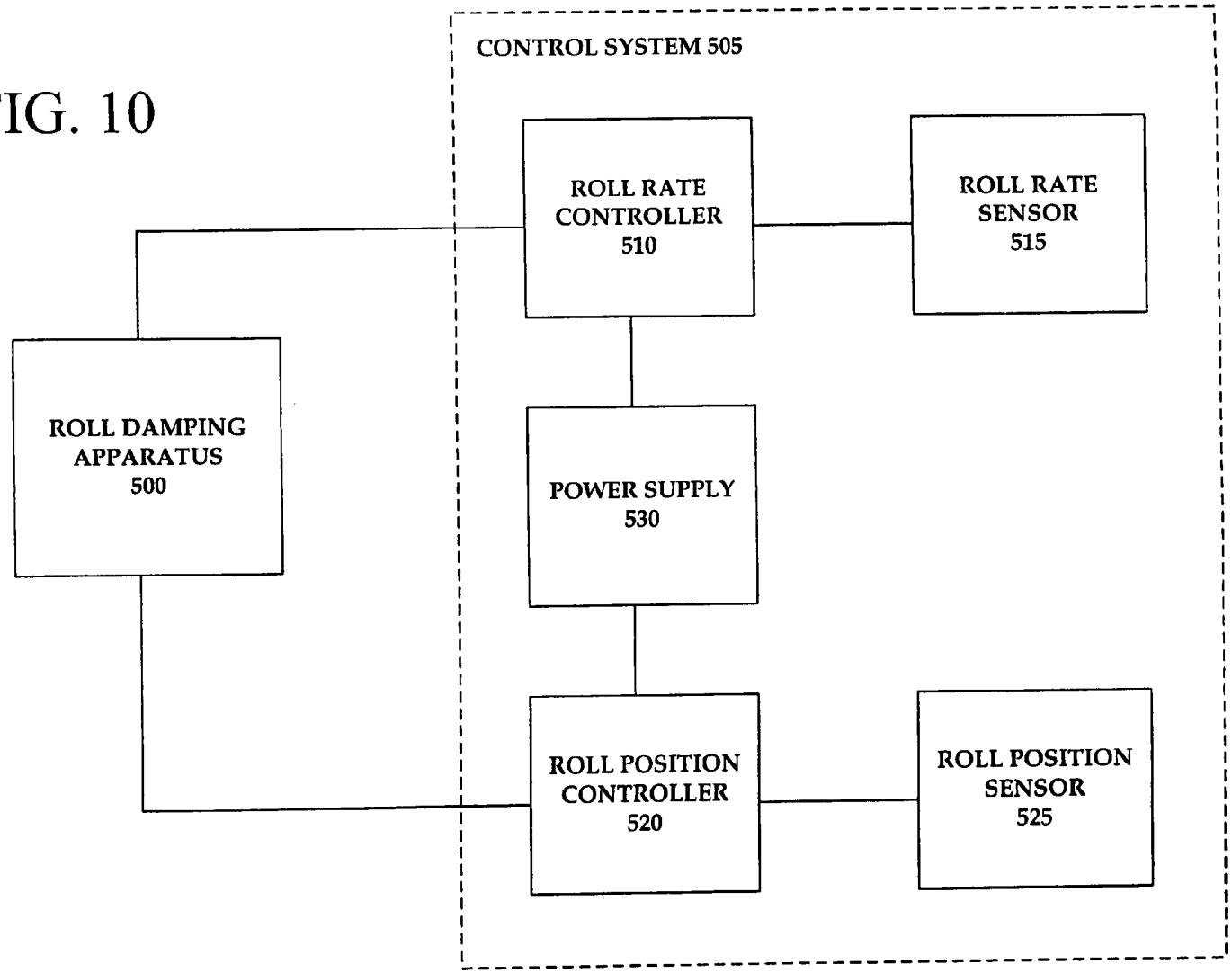
FIG. 10 is a schematic of an illustrative control system for a roll damping apparatus in accordance with one embodiment of the invention.

Course correction and navigation of the various projectile embodiments using the roll damping apparatus can be achieved with a suitable control system. The control system must be adapted to provide the requisite current to the roll damping apparatus to produce the desired frictional force to slow the rotation of the front section vis-à-vis the rear section of the projectile. FIG. 10 is a schematic of an illustrative control system for a roll damping apparatus in accordance with one embodiment of the invention.

As shown in FIG. 10, control system 505 includes a roll rate controller 510 coupled to a roll rate sensor 515, and a roll position controller 520 coupled to a roll position sensor 525. The roll rate controller 510 and roll position controller 520 are further coupled to a power supply 530, and the roll damping apparatus 500. Although shown as separate components, it should be appreciated that in some embodiments roll rate controller 510 and roll position controller 520 may be one device.

In operation, roll rate sensor 515 measures the nose inertial roll rate of the front section of the projectile upon firing. This rotation is imparted by the aerosurfaces externally mounted on the front section. Once the measured roll rate drops below a predetermined threshold, the roll rate controller 510 is activated. The roll rate controller 510 compares the measured roll rate to a commanded roll rate (in some embodiments, equals zero), and generates a control signal to the roll damping apparatus 500. In some embodiments, the control signal is in the form of current supplied to the roll damping apparatus 500 to produce a control torque necessary to despin the front section. The amount of current may be based on a proportional plus integral control law:

$$I_C=K_P\epsilon+K_I\int\epsilon dt$$

When the desired roll rate control has been established, the roll position sensor 525 measures the inertial roll orientation. In some embodiments, roll position sensor 525 may comprise a magnetometer. Once roll rate control has been achieved, the roll position controller 520 is activated. The roll position controller 520 compares the estimated roll position to a commanded roll position, and generates a control signal to the roll damping apparatus 500. In some embodiments, the control signal is in the form of current supplied to the roll damping apparatus 500 to produce a control torque necessary to control the front section. The amount of current may be based on a proportional plus integral plus derivative control law:

$$I_C=K_P\epsilon+K_I\int\epsilon dt+K_D\omega_S$$

Figure 11:
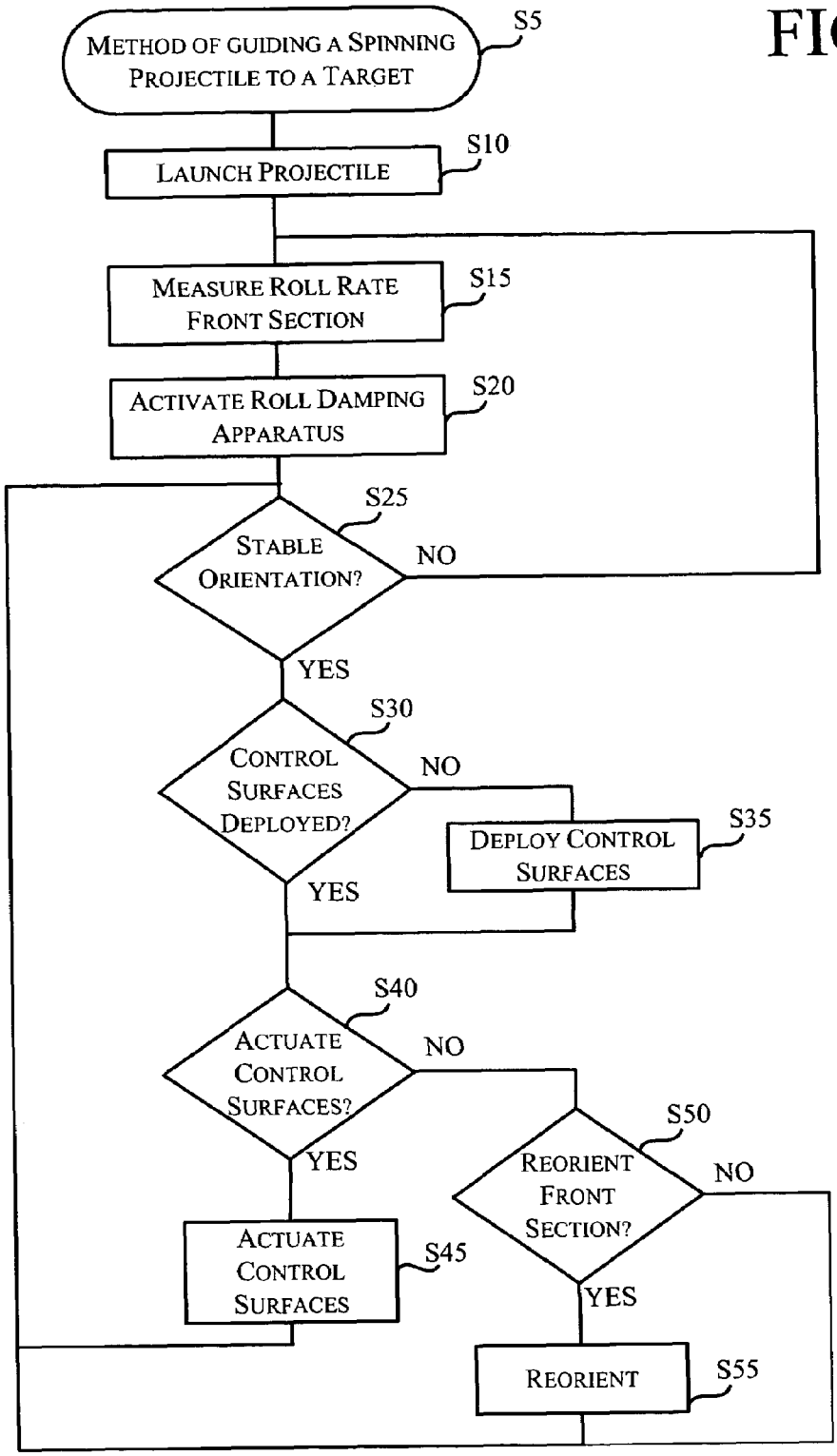
FIG. 11 is a flowchart illustrating a method of guiding a spinning projectile to a target in accordance with one embodiment of the invention.

Thus, the present invention further includes a method of guiding a spinning projectile, in accordance with the various embodiments described above, to a target. FIG. 11 is a flowchart illustrating such a method in accordance with one embodiment of the invention. The method, referred to as S5, begins with the launch of the spinning projectile in step S10. In this embodiment, the spinning projectile may comprise projectile 10, as described in detail above. Subsequent to launch, aerosurfaces mounted on the front section begin to apply torque to the front section counter to the rotation of rear section. This causes the front section to rotate in the opposite direction as the rear section. The method continues with the measuring of the roll rate of the front section in step S15.

Once the measured roll rate drops below a predetermined threshold, a control signal activates the roll damping apparatus in step S20. The control system then determines whether the front section has achieved a stable orientation in step S25. If not, the process returns to step S15. If the front section is in a stable orientation relative to the Earth inertial reference frame, the process pass to step S30, wherein the system determines whether the control surfaces have been deployed. If not, the control surfaces are deployed in step S35. The process then passes to step S40, wherein the system determines whether to actuate the control surfaces. If so, the process passes to step S45, wherein the control surfaces are actuated, and the process returns to step S25.

If the control surfaces are not to be actuated, the process passes to step S50, wherein the system determines whether a reorientation maneuver is desired for the front section. If so, the process passes to step S55, and the reorientation maneuver is executed. The operator (or controller system) can utilize the canards to control the trajectory of the projectile. The process then returns to step S25. If no reorientation is needed, the process returns to step S25 (bypassing reorientation step S55) to ensure a stable orientation is maintained while waiting for the next system command. In this embodiment, these steps used for controlling the rate of spin of the front section relative to the rear section are continuously repeated from the time of launch until impact. It should be appreciated that the above process may be repeated iteratively until the projectile impacts the target.

It will be readily appreciated that the mechanical devices of the present invention that provide for the controlled movement of the various components of the projectile and/or roll damping apparatus, may be controlled by automated systems known in the art. For example, one or more pre-programmed or programmable control systems may be used to automatically calculate and implement the necessary movements of the invention components to accomplish any desired movement. Moreover, the calculations necessary to automate the movement of the invention components are readily calculated using geometric and dynamic principles and equations, and such calculations are within the ordinary skill in the art of machine design. Input for automated and manual movements may be received by any useful input device, such as joysticks, or keypads or the like.

Other variations will be apparent and practicable without undue experimentation, in light of the present disclosure and with practice of the invention. For example, various components of the projectile and/or roll damping apparatus may receive input from or send output to a processing device machine to accomplish the desired function of the invention, such as the calculated control of the canards for steering the projectile, or controlling the frictional forces applied by the roll damping apparatus. The projectile and/or roll damping apparatus, or components thereof, may also receive commands from a controller workstation or other controller device through a processing device, or other mechanical components electronically coupled to or in communication with a processing device.

As used herein, the term processing device is to be understood to include at least one processor that uses at least one memory. The memory stores a set of instructions. The instructions may be either permanently or temporarily stored in the memory or memories of the processing device. The processor executes the instructions that are stored in the memory or memories in order to process data. The set of instructions may include various instructions that perform a particular task or tasks, such as those tasks described above. Such a set of instructions for performing a particular task may be characterized as a program, software program, or simply software. As noted above, the processing device executes the instructions that are stored in the memory or memories to process data. This processing of data may be in response to commands by a user or users of the processing device, in response to previous processing, in response to a request by another processing device and/or any other input, for example. The processing device used to implement exemplary embodiments of the invention may also be a general purpose computer. However, the processing machine described above may also utilize any of a wide variety of other technologies including a special purpose computer, a computer system including a microcomputer, mini-computer or mainframe, a programmed microprocessor, a micro-controller, an integrated circuit, a logic circuit, a digital signal processor, a programmable logic device, or any other device or arrangement of devices that is capable of implementing exemplary embodiments of the invention.

While the foregoing description includes details and specificities, it is to be understood that these have been included for purposes of explanation only, and are not to be interpreted as limitations of the present invention. Modifications to the embodiments described above can be made without departing from the spirit and scope of the invention, which is intended to be encompassed by the following claims and their legal equivalents.

What is claimed is:

1. A spinning projectile having a roll axis, comprising:

a front section rotatable about the roll axis;

a rear section rotatable about the roll axis, the rear section rotatably attached to the front section;

an aerosurface attached to the front section and adapted to create a first rotational torque counter to a spin of the rear section; and a roll damping apparatus including:

a first portion attached to the front section, a second portion attached to the rear section, wherein the first portion is adapted to cause a frictional force to act on the second portion, the frictional force being effective to control a spin rate of the front section relative to the rear section.

2. The spinning projectile of claim 1, wherein the first portion includes a stator housing.

3. The spinning projectile of claim 2 wherein the second portion includes a rotating assembly disposed at least partially within the stator housing.

4. The spinning projectile of claim 3, wherein the rotating assembly is at least partially disposed within a friction increasing material contained within the stator housing.

5. The spinning projectile of claim 4, wherein the first portion includes a magnetic field generator adapted for applying a magnetic field to the friction increasing material.

6. The spinning projectile of claim 5, wherein the magnetic field generator includes a coil circumferentially disposed about the friction increasing material.

7. The spinning projectile of claim 4, wherein the friction increasing material comprises magneto-rheological fluid.

8. The spinning projectile of claim 1, wherein the second portion includes a rotatable housing attached to a rotatable shaft.

9. The spinning projectile of claim 8, wherein the first portion is at least partially disposed within the rotatable housing.

10. The spinning projectile of claim 9, wherein the second portion includes a braking member disposed between the rotatable housing and the first portion.

11. The spinning projectile of claim 10, wherein the first portion includes a magnetic field generator adapted to produce a magnetic field that causes braking member to contact the first portion.

12. The spinning projectile of claim 1, wherein the aerosurface comprises a plurality of aerosurfaces.

13. The spinning projectile of claim 12, wherein the frictional force created by the roll damping apparatus is effective to balance the first rotational torque and to spin or despin the first section.

* * * * *

UNITED STATES PATENT AND TRADEMARK OFFICE

CERTIFICATE OF CORRECTION

PATENT NO. : 7,412,930 B2
APPLICATION NO. : 10/955682
DATED : August 19, 2008
INVENTOR(S) : Smith et al.

It is certified that error appears in the above-identified patent and that said Letters Patent is hereby corrected as shown below:

Title Page, Item (73) Assignee should read as following:
General Dynamics Ordnance and Tactical Systems, Inc., St. Petersburg, FL (US)

Signed and Sealed this

Thirtieth Day of September, 2008

JON W. DUDAS
*Director of the United States Patent and Trademark Office*